United States Patent [19]

Lehmann

[11] Patent Number: 4,782,804

[45] Date of Patent: Nov. 8, 1988

[54] CENTRIFUGAL SPEED GOVERNOR FOR INTERNAL COMBUSTION ENGINES

[75] Inventor: Werner Lehmann, Gerlingen, Fed. Rep. of Germany

[73] Assignee: Robert Bosch GmbH, Stuttgart, Fed. Rep. of Germany

[21] Appl. No.: 113,273

[22] PCT Filed: Dec. 4, 1986

[86] PCT No.: PCT/DE86/00498

§ 371 Date: Jul. 27, 1987

§ 102(e) Date: Jul. 27, 1987

[87] PCT Pub. No.: WO87/03647

PCT Pub. Date: Jun. 18, 1987

[30] Foreign Application Priority Data

Dec. 6, 1986 [DE] Fed. Rep. of Germany ..... 3543157

[51] Int. Cl.[4] ..... F02M 39/00

[52] U.S. Cl. ..... 123/365; 123/366; 123/372

[58] Field of Search ..... 123/365, 366, 372, 373, 123/357–359

[56] References Cited

U.S. PATENT DOCUMENTS

| | | | |
|---|---|---|---|
| 3,530,845 | 9/1970 | Staudt et al. . | |
| 3,620,199 | 11/1971 | Kuhn | 123/365 |
| 3,727,598 | 4/1973 | Knapp | 123/179 L |
| 3,973,542 | 8/1976 | Shum . | |
| 4,054,112 | 10/1977 | Kurokawa | 123/383 |
| 4,164,925 | 8/1979 | Maier et al. . | |
| 4,243,004 | 1/1981 | Ritter | 123/372 |
| 4,252,089 | 2/1981 | Kramer | 123/265 |
| 4,305,362 | 12/1981 | Schwartz et al. . | |
| 4,498,437 | 2/1985 | Ohkoshi | 123/365 |
| 4,586,470 | 5/1986 | Klinger et al. . | |

FOREIGN PATENT DOCUMENTS

| | | | |
|---|---|---|---|
| 3296869 | 7/1983 | Fed. Rep. of Germany | 123/383 |
| 3414846 | 10/1985 | Fed. Rep. of Germany . | |
| 1585720 | 1/1970 | France . | |
| 2373682 | 7/1978 | France . | |
| 0060827 | 5/1981 | Japan | 123/373 |
| 0110733 | 7/1982 | Japan | 123/179 L |
| 319357 | 3/1957 | Switzerland . | |
| 0437999 | 11/1935 | United Kingdom | 123/179 L |
| 681122 | 10/1952 | United Kingdom . | |
| 740674 | 11/1955 | United Kingdom . | |
| 2028425 | 3/1980 | United Kingdom | 123/365 |
| 2030321 | 4/1980 | United Kingdom . | |

OTHER PUBLICATIONS

European Patent Office Search Report dated Dec. 18, 1986 for application EP 85 103 151.8.

European Patent Office–Office Action dated Jun. 16, 1987 for application EP 85 103 151.8.

"Fuel Injection Equipment for Diesel Engines (2): Governors for In-Line Pumps" 1975 Robert Bosch GmbH (pp. 36–42; French translation (title page).

"Fuel Injection Equipment for Diesel Engines: Fuel Injection Pumps PE and PF" Robert Bosch GmbH (p. 14).

"Drehzahlregler fuer Einspritzpumpen PE" Robert Bosch GmbH (pp. 34 and 35).

*Primary Examiner*—Carl Stuart Miller

*Attorney, Agent, or Firm*—Michael J. Striker

[57] ABSTRACT

Idling/final speed governor for internal combustion engines, having a centrifugal-weight regulator (4) which is used for controlling the idling and final speed and produces, against the force of control springs (8), a regulating force corresponding to the engine speed, having a coupling (9) present between a control rod (3), used for controlling the quantity, and the centrifugal-weight regulator (4), having a governor sleeve (7) which has a drag member and having a link (13) between an intermediate lever (12), belonging to the coupling (9), and the control rod (3), with this link (13) having a slide (26) which can be displaced in the quantity-regulating direction, is loaded by a starting spring (27) in the direction of increasing injection quantity and interacts with a full-load stop (32) which is fixed per se but can be changed as a function of operating parameters, such as, for example, by a supercharge-pressure regulator (33), with this change in the stop position signifying a control-travel change which is compensated by a deflection travel A of the drag member (14) in the governor sleeve (7).

22 Claims, 3 Drawing Sheets

A
B
S
I
II

CENTRIFUGAL SPEED GOVERNOR FOR INTERNAL COMBUSTION ENGINES

BACKGROUND OF THE INVENTION

The invention is based on an idling/final speed governor for internal combustion engines. The exacting requirements imposed on the exhaust-gas quality and on the specific performance with regard to the fuel consumption of the allocated internal combustion engine impose corresponding requirements on an idling/final speed governor leading to increasingly more complicated governor designs. On the one hand, this has increased the manufacturing costs of the governors, and on the other hand, special embodiments of the governors have arisen which can be used only for certain internal combustion engines to meet certain demands.

In a known idling/final speed governor (Swiss Patent Specification No. 319,357), the full-load stop of the quantity-control member (control rod) is arranged on a swing-out lever which, via a crescent-shaped lever articulating this swing-out lever, is always swung out of the stop position when the centrifugal-weight regulator moves into its inoperative or initial position. At the same time, a weak pressure spring is compressed. In this stop-free adjustment, the control rod can be displaced into a starting position, i.e. into a position beyond the full-load position, in which an extra fuel quantity required for starting the cold internal combustion engine is delivered by the injection pump. When the internal combustion engine is started at an adequate speed, and the centrifugal-weight regulator, driven by the centrifugal weights, lifts from the crescent-shaped lever, the pressure spring shifts this crescent-shaped lever to the extent that the level bearing the stop is swung back into the full-load stop position so that only the full-load quantity can be delivered as a maximum injection quantity.

Quite apart from the fact that this design is relatively complicated and relatively laborious to assemble, setting the locking and release of the starting travel requires additional assembly time. Moreover, the pressure spring acting on the crescent-shaped lever not only acts in the inoperative position of the centrifugal-weight regulator but also in the idling speed range on its regulating sleeve, so that the force of the pressure spring is superimposed on the force of the idling spring acting against the centrifugal forces of the centrifugal weights. This neutralizing of the pressure spring disadvantageously produces a corresponding "jump" in the idling control curve, which for the operation of the internal combustion engine is manifested as so-called "surging" during idling.

The harmful substances in the exhaust gas always increase if the extra starting quantity required for starting the internal combustion engine is not cut back again by the governor after starting or if, for example when the accelerator pedal is fully depressed, the full-load stop limiting the full-load quantity does not come into action and the extra starting quantity is thereby injected. The latter, in this known governor, can disadvantageously occur if the internal combustion engine, when travelling downhill, is disengaged for saving fuel and is stopped by interruption in the injection. During this procedure, the crescent-shaped and the swing-out levers are displaced by the centrifugal-weight regulator into a position in which the full-load stop is no longer effective. If, for example on an uphill roadway, the internal combustion engine is started up again after engaging while utilising the moving vehicle mass, which can also be effected by the starter, and as long as the accelerator pedal is fully depressed, the control rod maintains the position previously assumed for the extra starting quantity. The swing-out lever, with its stop, is certainly pushed again in the direction of the locking position by the pressure spring, but without being able to exert an effect on the control rod, because the latter is already in the position for the extra starting quantity. The internal combustion engine therefore receives an insufficiently combustible extra quantity of fuel, in fact until the accelerator pedal is throttled back and the control rod is pulled into a normal working position which is then limited in the direction of maximum injection quantity by the full-load stop.

It is known that the fuel quantity combustible free of smoke is greater if the combustion air supplied to the internal combustion engine is supercharged (compressed). Accordingly, the full-load stop is adjustable between aspirated operation and supercharged operation, which is mostly effected by a device on the fuel injection pump side remote from the governor (Bosch—publication VDT-AKP 4/1, 1st issue August 73; p. 34). The end stop of the control rod is also arranged here on this side of the injection pump, which end stop also determines the maximum extra starting quantity. This end stop must be positioned in such a way that, in supercharged operation, the requisite full-load injection quantity can still be delivered, which in some internal combustion engines can be greater than the extra starting quantity in aspirated operation. As a result of the design, however, the end stop for the extra starting quantity permits a further, even if small, stroke in the direction of greater injection quantity than is necessary for the full-load quantity during super-charged operation. This position, due to the design, of the end stop of the control rod causes a relatively high proportion of toxicants to develop in the exhaust gas, for in most internal combustion engines an extra starting quantity which is the same as or greater than the full-load quantity required for super-charged operation leads to exhaust gas emissions which are harmful to the environment.

The applicants have also disclosed idling/final speed governors of the type described in which the position of the lever which bears the stop of the control rod and can be pivoted by the crescent-shaped lever adjusted in such a way by a device inside the space of the speed governor, which device works as a function of the positional [sic] pressure, that in one position there is a full-load stop for aspirated operation and in the other position there is a full-load stop for supercharged operation. But even in this way the abovementioned disadvantages are not avoided.

It is also known (German Offenlegungsschrift No. 3,246,869) to disengage such a full-load stop, variable as a function of its supercharge pressure, via an operating magnet in order to thereby make possible an extra starting quantity. In this govenor, there is also the fact that an electrical control means is required for starting, and if this means fails, an extra starting quantity and thus starting of the internal combustion engine is not possible or is made very difficult.

In a known idling/final speed governor of the generic type (German Offenlegungsschrift No. 3,414,846), the extra starting quantity is controlled via a starting spring which is compressed for starting, after appropriately fully depressing the accelerator pedal and displacing the control rod into the position for extra starting quantity, and is then extended again, after starting, in order to displace the control rod into a normal working position between idling and full load. During this procedure, the starting spring acts on a full-load stop bolt which, having a head, with the spring extended and in the initial position of the bolt, limits the full-load injection quantity. However, for this speed governor, which is simpler per se, the position of the stop cannot be changed as a function of operating parameters, such as, for example, the supercharge pressure, without at the same time engaging in the control range of the starting spring.

SUMMARY OF THE INVENTION

In contrast, the idling/final speed governor according to the invention has the advantage that the governing system can be engaged while allowance is made for operating parameters, such as, for example, the supercharge pressure, without affecting the control means of the extra starting quantity. By shifting the starting spring into a starting device displaceable with the quantity-control member, this spring and also the starting travel of the quantity-control member, for example the control rod, can be set in a simple manner on the governor side of the injection unit. Regulating the full-load stop as a function of operating parameters does not cause any change in the force of the starting spring, since the starting spring is integrated with the quantity-control member and reciprocates with the latter. Apart from these spatial and functional advantages, expensive control parts, such as, for example, a crescent-shaped lever, a pivot lever bearing the stop, a pressure spring, etc., can be dispensed with in such a governor, and no time-consuming fitting of the articulation of the crescent-shaped lever into the lever bearing the stop is necessary. The complicated setting operation for locking and release of the starting travel is thus completely dispensed with in advantageous manner. Moreover, the idling curve no longer has the jump which is caused by the pressure spring and which, as described above, can lead to surging of the internal combustion engine. In this governor according to the invention, running unintentionally on extra starting quantity is avoided after starting.

By integrating the starting spring with the quantity-control member in idling/final speed governors of this type, the starting spring solution described, can advantageously be used even if an additional imposition is made which requires a positional change in the full-load stop. In the governor according to the invention, the extra starting quantity, when required, can be set lower than the increased full-load quantity which is required, for example, during supercharged operation. In addition, the starting travel can be advantageously determined by the stroke of the slide interacting with the starting spring, which takes place completely irrespective of the position of the full-load stop which by itself can be set as a function of operating parameters.

Because of the action of the starting spring during the governing of the extra starting quantity, this extra starting quantity is reduced substantially quicker than in the known governors working with the imposition of operating parameters.

According to an advantageous development of the invention, the starting device connected to the quantity-control member is arranged inside a link having a guide rod surrounded by the starting spring and intended for the slide, with the link acting as an articulation between on the one side the quantity-control member and on the other side the intermediate lever of the coupling, which intermediate lever leads to the governor sleeve. The slide therefore also acts like a drag member, since it is displaceable on the guide rod against the force of the starting spring so that satisfactory sliding can be achieved without sticking. By the arrangement inside the link, the requisite flexibility during the force transmission between the coupling and the quantity-control member is maintained and also the possibility is created of obtaining here an independent part, which can be manufactured independently and is first preset and then fitted into the governor.

According to a further essential development of the invention, the position of the full-load stop can be changed in the regulating direction of the quantity-control member as a function of operating parameters, such as, for example, the supercharging, with, corresponding to this travel and limited at least approximately to this value, a deflection travel in the governor sleeve being available to the drag member of the centrifugal-weight regulator. For another purpose, it has already been proposed (abovementioned German Offenlgungsschrift No. 3,414,846) to preset a deflection travel in the governor sleeve, with this deflection travel corresponding to a difference in travel between a normal test position of the control rod and its full-load position which is determined by the stop, so that, when the governor is stopped and when the drag member is blocked, the idling spring overpresses the starting spring of a control-rod stop. Unlike this known proposal, in the combination according to the invention, when the position of the full-load stop changes as a function of operating parameters, this difference in position can advantageously be taken up by the deflection travel at the drag member, with the quantity-control member accordingly being additionally displaced against the force of the starting spring by the drag member, which, to produce the extra starting quantity, is then blocked, in the governor sleeve. The deflection travel at the drag member is therefore used here for compensating the control-rod travel between the stop position during aspirated operation and during supercharged operation and enables the extra starting quantity to be injected in the blocked position.

According to a further development of the invention, the quantity-control member has an additional stop which can be engaged as a function of temperature and which, during warm starting, prevents displacement in the direction of the extra starting quantity, that is, it also prevents the starting spring from being overpressed. In this way, the control rod, when the internal combustion engine is warm, is prevented from being displaced into a position for extra starting quantity, which could lead to a puff of smoke. According to a development of the invention, this additional stop is directly articulated on the element bearing the full-load stop, so that, if for example this full-load stop is displaced because of operating parameters, the additional stop can also be displaced by the same amount of travel without disadvantage, since the extra starting quantity is also possible in the position for aspirated operation, so that this results in a very simple design solution.

A development of the link acting as an articulation between on the one side the quantity-control member and on the other side the intermediate lever leading to the governor sleeve, which embodiment is favourable from a production point of view and is prepared for incorporating further functions, results if the starting device connected to the quantity-control member is arranged inside this link in a guide bore guiding the slide and accommodating the starting spring. So that damage to governor parts in sliding operation can also be prohibited in the case of a sluggish throttle linkage or when the drag members of this linkage are not resilient enough, it is particularly advantageous if a second link body is arranged coaxially to a first link body accommodating the guide bore, with the slide and the starting spring, and also an articulation point for the quantity-control member, which second link body is guided on this first link body and is provided with a drag spring and also an articulation point for the intermediate lever. In this arrangement, the drag spring is supported against both link bodies and, during normal and starting operation of the governor, secures these link bodies in their initial position holding the two articulation points at a fixed distance. Thus a requisite increase in the distance between the articulation points is possible during sliding operation with regulating lever secured in the stopped position.

So that the extra starting quantity planned for cold starting is not injected during warm starting into the working cylinder of the internal combustion engine, i.e. when the internal combustion engine is heated up to normal operating temperature, it is proposed to arrange inside the link accommodating the starting device a working element which changes its effective length as a function of temperature and at least indirectly blocks the starting travel S of the slide. Thus this device located inside the governor housing avoids unauthorised interference. A trouble-free type of construction of the link accommodating the starting device, which type of construction works with proven means and blocks the extra starting quantity in thermostatically controlled manner, results if, according to the characterizing features of claim 9, the working element, preferably formed by an expansion transducer, is arranged in a bore passing through the slide. In this arrangement, the requisite starting travel S is controlled by a stop sleeve against which the housing of the working element is supported. A restoring spring for the stop sleeve and a deflection spring for the working element prevent the components of the link from being destroyed by the very high accelerative forces occurring in diesel internal combustion engines, with the deflection spring absorbing in known manner an excess stroke of the working element, which excess stroke occurs as temperatures increase further. For a satisfactory function, the pretensioning force ofthe restoring spring must be greater than the pretensioning force of the starting spring but smaller than the pretensioning force of the deflection spring.

An especially space-saving type of construction of the link equipped with the thermostatically-working working element, which type of construction takes up no additional construction space, results if the working element is formed by a compression spring which is made of a memory alloy and is arranged coaxially to the starting spring and the effective length of which, during cold starting, releases the starting travel of the slide but blocks the latter during warm starting, i.e. at normal operating temperatures.

In order to prohibit overloading of the governor components during sliding operation, when the regulating lever is secured in the stopped position and the control rod is in the stopped position, an especially advantageous solution which does not affect the type of construction of the link equipped with the starting device results if the governor sleeve equipped with the drag member containing the drag spring also contains a deflection spring which, during sliding operation, permits a requisite increase in the distance available in the no-load condition between the connecting locations for the centrifugal weights and for the coupling. Continuous adjustment of the deflection travel A of the drag member can be achieved in an especially expedient manner by an adjusting nut screwed onto a thrust bolt provided with a threaded bolt and bearing the threaded bolt [sic], with the adjusting nut being supported on one side against the drag spring and on the other side against a shoulder inside a recess, accommodating the drag spring, of a sliding sleeve which is longitudinally displaceable in a central bore of the governor sleeve and which is pressed in turn by the deflection spring against a positional stop.

Further advantages and advantageous developments of the invention can be gathered from the following description, the drawings and the claims.

BRIEF DESCRIPION OF THE DRAWINGS

An exemplary embodiment of the subject-matter of the invention is shown with several variants in the drawing and described in greater detail below.

FIG. 1 shows a simplified representation of an idling-/final speed governor, FIG. 2 shows a longitudinal section through the governor sleeve along line II—II in FIG. 1, FIG. 3 shows a functional diagram with governor curves, FIG. 4 shows a view of the first variant of the governor shown in FIG. 1, with an additional thermostatic control member, FIG. 5 shows the link of the second variant, which link contains the starting device, FIG. 6 shows the link of the third variant, which link is equipped with a member, working as a function of temperature, in the starting device, FIG. 7 shows the thermostatically controlled link of the fourth variant, which link is of a different design from the link in FIG. 6, and FIG. 8 shows a longitudinal section according to FIG. 2, but through a governor sleeve provided for a fifth variant of the governor according to the invention.

DESCRIPTION OF THE PREFERRED EMBODIMENTS

Figures 1, 2:
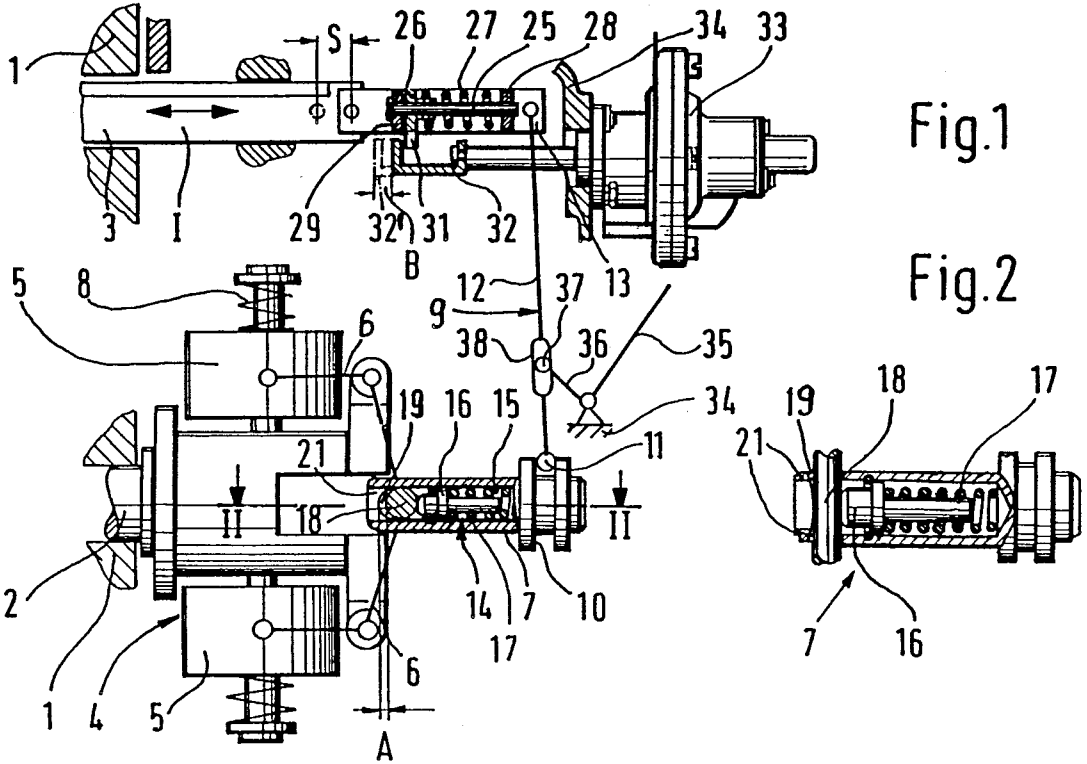

The essential parts of an idling/final speed governor according to the invention are shown in FIG. 1. This governor, which is only exemplary, is attached to an in-line injection pump, of which only the housing 1, a camshaft 2 and a control rod (item "3" will henceforth be allocated to this term) acting as a quantity-control member 3 are shown here. It is known that the camshaft 2 is driven at a speed proportional to the speed of the internal combustion engine and drives a centrifugal-weight regulator 4. The control rod 3 is displaceable in reciprocating manner in the regulating direction I identified by a double arrow, with here a displacement to the left resulting in an increasing injection quantity (+) and a displacement to the right resulting in a decreasing injection quantity (−). The centrifugal-weight regulator 4 has two centrifugal weights 5 which, under the action of the centrifugal forces, developing during rotation, against the forces of control springs, actuate a governor sleeve 7 via bell-crank levers 6. In each case only one of the control springs is shown, namely the idling spring 8. Apart from this idling spring 8, at least one final control spring and also a compensating spring usually act on each centrifugal weight 5, but this is unimportant for the description of the function of the invention.

Provided on the governor sleeve 7 is an annular groove 10 into which a sliding block 11 which is shown considerably simplified engages and is arranged on the end of an intermediate lever 12 which, with its other end, is connected to a link 13 of the control rod 3 and is thus part of a coupling 9 between the centrifugal-weight regulator 4 and the control rod 3. In addition, the governor sleeve 7 is equipped with a drag member 14 which has a thrust bolt 16, axially displaceable into a central bore 15 of the governor sleeve 7, a drag spring 17, acting on this thrust bolt 16, and a connecting bolt 18 which is mounted at rightangles to the regulating direction and on which acts the bell-crank lever 6 with this bolt 18 being guided in longitudinal grooves 19 (FIG. 2) of the governor sleeve 7. The possible travel of this connecting bolt 18 is limited by the length of the longitudinal grooves 19, which is determined on one side by wall pieces 21 of the governor sleeve 7 and establishes the deflection travel A of the drag member 14.

The link 13, which forms a connection, inflexible per se, between the intermediate lever 12 and the control rod 3, has, as part of a starting device 23, a guide rod 25 which is arranged in the regulating direction I and on which a slide 26 is guided in longitudinally displaceable manner. Acting on the slide 26 is a starting spring 27 which is supported on the other side against a web 28 holding the rod 25 and connected in fixed manner to the link 13. The initial position shown of the slide 26 is determined by a second web 29 likewise bearing the rod 25. When the control rod 3 and therefore the link 13 are displaced, the slide 26 is accordingly moved along with them.

Radially provided on the slide 26 is a pin 31 which interacts with a full-load stop 32 which can be displaced via a supercharge-pressure regulator 33 which is fixed on the housing 34 of the governor. This stop 32 acts as a full-load stop, adjustable as a function of the supercharge pressure, for the control rod 3, i.e., not only the maximum fuel quantity which can be injected during normal operation is limited by this stop 32. The position shown in FIG. 1 of the stop 32 corresponds to aspirated operation, hence a slightly smaller full-load injection quantity. But when the internal combustion engine is supercharged, i.e., the combustion air supplied to the cylinders is blown in under pressure, the specific fuel consumption increases, and correspondingly of course so too does the power, so that the full-load stop 32 must also admit a greater maximum injection quantity and accordingly be displaced by the supercharge-pressure regulator 33 by the amount of travel B to the left into the position 32' shown in a broken line.

The governor is operated at will via a regulating lever 35 which is mounted on the governor housing 34 and is actuated by the driver of the motor vehicle, for example via the accelerator pedal, and which engages into a connecting-link guide 38 of the intermediate lever 12 via a steering lever 36 and a pin 37.

The centrifugal speed governor described works as follows: in the position shown the regulating lever 35 is in the full-load position which is generally determined by a stop (not shown). In this position, the pin 31 bears against the full-load stop 32, which corresponds to a certain full-load injection quantity. As soon as the turbocharger then supercharges the internal combustion engine, the stop 32 is displaced via the supercharge-pressure regulator 33 by the amount of travel B into the position shown in a broken line, and the control rod 3 is correspondingly displaced to the left into a position for a greater full-load injection quantity. On the other hand, the position shown of the centrifugal weights 5 corresponds to a low speed. As soon as the speed increases, for example as a result of a decrease in the engine load, the centrifugal weights 5 move outwards against the force of the idling springs 8 until equilibrium develops between the centrifugal force of the weights 5, which is caused by the speed, and the force of the springs 8. During this outwards movement of the centrifugal weights 5, the governor sleeve 7 is pulled to the left via the bell-crank lever 6 and by the connecting bolt 18 and at the same time, via the annular groove 10, carries along with it the sliding block 11, the intermediate lever 12 and the link 13 so that the control rod 3 is displaced to the right into a position for smaller injection quantities. The pin 37 at the same time acts as a pivot bearing for the intermediate lever 12. The idling speed is always governed in an idling position of the regulating lever 35 (the pin 31 does not bear against the stop 32), whereas the stop 32 only determines the maximum injection quantity, with the governor ensuring that the engine does not race despite this maximum injection quantity. The partial-load range is selected at will by the driver by more or less adjusting the regulating lever 35 in accordance with the accelerator pedal, following which in turn is a corresponding position of the control rod 3, whereupon, depending on the load on the engine, hence the load on the vehicle, an average speed occurs. The accumulator 14, by means of the deflection travel A, also stores the difference in the control travel between supercharging and aspirated operation. During starting, during which the centrifugal weights 5 are in their inoperative position, the starting spring 27 is overpressed according to the starting travel S so that the control rod 3 is displaced corresponding far to the left into an extra-quantity position more or less exceeding the full-load position. But as soon as the internal combustion engine has then been started, the control rod 3 is pulled back again by the centrifugal weights 5 in the manner described above to the extent that the starting spring 27 is relieved of load and assumes the position shown in which the slide 26 bears against the web 29. For a satisfactory function of the governor, it is therefore necessary, in the inoperative position of the centrifugal weights 5, for the force of the idling springs 8 to outweigh the pretensioning force F3 of the starting spring 27. In addition, the force of the drag spring 17 must be smaller than the pretensioning force of the starting spring 27, which pretensioning force is reduced to the governor sleeve 7, but, when the control rod 3 is freely movable, it must be greater than the regulating force of the centrifugal-weight regulator 4, which regulating force is required for regulating the control rod 3 and is transmitted by the governor sleeve 7.

Figure 3:
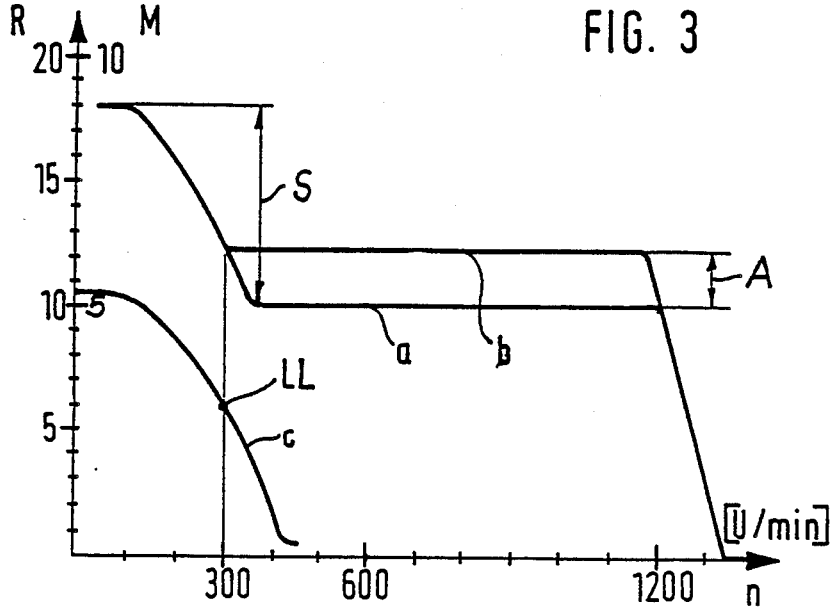

In the diagram contained in FIG. 3 for explaining the function of the invention, the speed n in revolutions per minute of the centrifugal-weight regulator 4 is plotted over the abscissa and the control travel R of the control rod 3 is plotted over the ordinate. The curve a corresponds to the governor function during aspirated operation and the curve b during supercharged operation. Moreover, a curve c is shown which corresponds to idling control and has an idling point LL which was aimed at, for example at $n_L = 300$ rev/min. On the ordinate, apart from the control travel R, the sleeve travel M of the governor sleeve 7, on the side facing the curves, is also plotted for a leverage at the intermediate lever of 1:2. The starting travel S determining the extra starting quantity is drawn in the diagram starting from the full-load control travel during aspirated operation, which full-load control travel is identified by the horizontal part of curve a.

When the regulating lever 35 assumes the position shown in FIG. 1 and centrifugal weights 5 have run through their idling stroke, the position shown of the governor parts corresponds to a speed of about 600 rev/min. The pin 31 bears against the stop 32, with the maximum delivery quantity for aspirated operation being set. Even when the speed changes, the control rod 3 remains in the position shown in accordance with the horizontal section of the curve a. Only when a speed of n=1200 rev/min is reached is the control slide 3 pulled to the right in accordance with the dropping section of the curve a, whereby the injection quantity is reduced until a new, reduced speed occurs or the internal combustion engine stops. The governor works in the same way when the stop 32, on account of supercharged operation being started, is displaced to the left so that the governor operation corresponds to curve b. Governing then begins at a slightly lower maximum speed, namely about 25 rev/min less than during aspirated operation, after which, however, the governing sections of a and b run virtually identically. During the transition from aspirated operation (a) to supercharged operation (b), the deflection travel A of the governor sleeve 7 is used up. But even for the range of the extra starting quantity the corresponding sections of the control curves a and b run virtually identically up to the intended idling speed LL, whereas after that, above this idling speed, during aspirated operation, the transition from the starting speed range horizontally to the full-load range of the curve a takes place approximately at 350 rev/min, namely displaced by an amount of travel A of the governor sleeve. This deflection travel A and the different position of the full-load stop during aspirated operation and during supercharged operation have no effect on the actual action of the starting and full-load control range or on the idling control range. Governing at final speed runs identically, so that during supercharged operation final governing starts at a slightly lower speed than during aspirated operation. Control of idling speed is independent of full-load control or final speed control. The position of the full-load stop can, of course, also be changed by operating parameters other than the supercharging of the engine.

Figure 4:
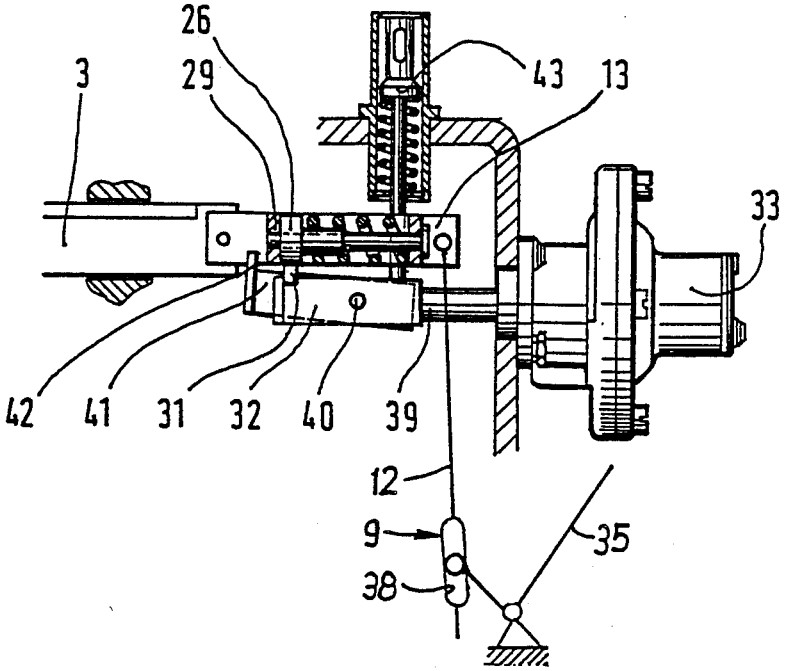

In the first variant, shown in FIG. 4, of the exemplary embodiment shown in FIGS. 1 and 2, the full-load stop 32 is likewise made as an angled sheet-metal part which is firmly connected to a regulating rod 39 of the supercharge-pressure regulator 33 and with the angled end section interacting eith the pin 31 of the slide 26. But in addition a further stop 41 is arranged via a pivot axis 40 on the full-load stop 32 as a part of an additional control member, which stop 41 likewise consists of an end section of a lever 42 made of angled sheet metal and as a warm-start limit stop interacts with the web 29 of the link 13, with this stop 41 being pivotable into the travel or out of the travel of the link 13 via a working element 43 working as a function of temperature. The working element 43, with its housing 44, is fixed on the governor housing 34.

As soon as the internal combustion engine is warm, the stop 41 is swung into the position shown via the working element 43, whereby the mobility of the control rod 3 is blocked in the direction of the extra starting quantity. In this way, a puff of smoke caused by the extra quantity is prevented from occurring during a so-called warm start. When the internal combustion engine has cooled down again after a prolonged stop, the lever 42 is pivoted about the axis 40 to the extent that the lever 42 can no longer engage with the web 29. Otherwise, this variant works like the speed governor shown in FIG. 1.

In the case of the components described below with reference to FIGS. 5 to 8 for the second to fifth embodiment variants of the exemplary embodiment shown in FIGS. 1 and 2, the same parts are designated identically, parts of different construction are designated with an upper case letter—A for the second variant, B for the third variant, C for the fourth variant, and again A for the fifth variant because of the governor sleeve, which is only modified in this variant—and new parts receive a new reference numeral.

Figure 5:
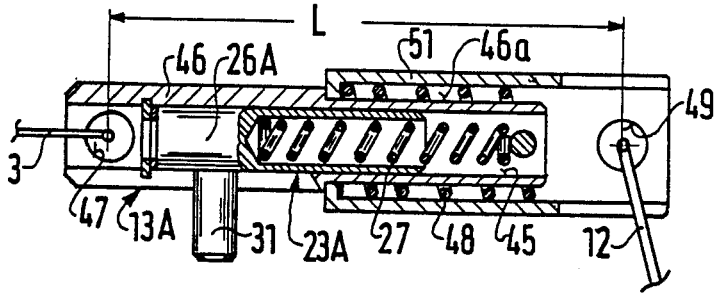

In the link 13A shown in FIG. 5 for the second embodiment variant, the slide 26A of the starting device 23A is guided inside a guide bore 45 of a first link body 46, which guide bore 45 also accommodates the starting spring 27. This first link body 46, designed as a rotary part, has at one end an articulation point 47 for the control rod 3, which articulation point 47 is formed by a transverse bore and, like the intermediate lever 12 articulated on the other end of the link 13A, is only indicated partially and schematically. Like the slide 26 guided in FIGS. 1 and 4 on the guide rod, the slide 26A bears the pin 31 interacting with the full-load stop 32 and projecting laterally. A second link body 51 under the pretensioning force of a drag spring 48 and containing in the form of a transverse bore an articulation point 49 for the intermediate lever 12 is guided on a step **46*a* of the link body 46. The drag spring 48 is supported on both link bodies 46 and 51 and therefore holds these bodies in the initial position shown which fixes a distance L between the two articulation points 47 and 49. The two link bodies 46 and 51 assume the initial position shown during the normal idling and load operation as well as the starting operation of the governor; but during sliding operation, with the regulating lever 35 secured in the stopped position and the control rod 3 already in the stopped position, the drag spring 48 permits a requisite increase in the distance L between the articulation points 47 and 49 so that the regulating forces introduced into the governor are limited by the force, then effective, of the drag spring 48**.

Figure 6:
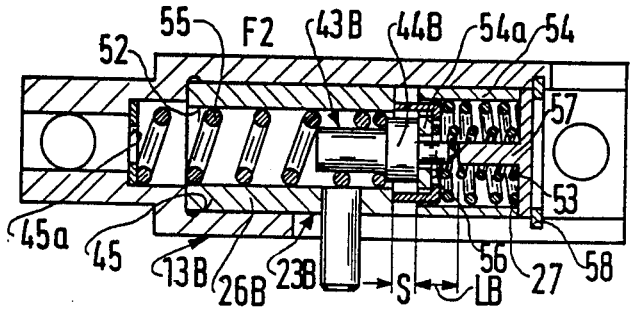

In FIG. 6, the link 13B of the third variant is shown which, inside a bore 52 passing through the slide 26B, accommodates a working element 43B formed by an expansion transducer. The working element 43B, with a housing 44B, is supported on one side against a stop sleeve 54, under the pretensioning force F1 of a restoring spring 53 and limiting with a base part **54*a* the starting travel S, and on the other side is under the pretensioning force F2 of a deflection spring 55 which extends through the bore 52 of the slide 26B up to a shoulder 45*a* of the guide bore 45 stepped several times and passing through the link 13B in the longitudinal direction. A pinlike actuating member 56 projecting with an effective length LB out of the housing 44B of the working element 43B is supported against a mushroom-shaped abutment 57 fixed in the guide bore 45 by means of a snap ring 58. For a satisfactory function, the pretensioning forces of the springs are to be dimensioned in such a way that the pretensioning force F1 of the restoring spring 53 is greater than the pretensioning force F3 of the starting spring 27 but smaller than the pretensioning force F2 of the deflection spring 55. The link 13B is shown in the position in which the slide 26B belonging to the starting device 23B, during cold starting, can cover the starting travel S predetermined by the length of the stop sleeve 54. If the operating temperature of the internal combustion engine and thus the temperature of the parts fitted into the link 13B, and therefore also the temperature of the working element 43B, increase, the effective length LB of the actuating member 56 increases, the housing 44B of the working element 43B moves to the left from the position shown while the deflection spring 55 is compressed, and the stop sleeve 54 follows this movement under the force of the restoring spring 53. At the same time, the starting travel S is gradually reduced until it becomes zero at the normal operating temperature of the internal combustion engine. Thus the mobility of the slide 26B is blocked and no extra starting quantity can be injected when the governor is stopped, since the pretensioning force F1 of the restoring spring 53 is not only greater than the pretensioning force F3 of the starting spring 27 but is also greater the than [sic] force of the idling springs 8 in the centrifugal-weight regulator 4, which force is reduced to the link 13B**.

Figure 7:
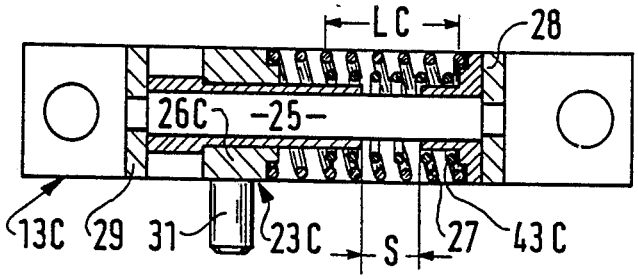

The link 13C of the fourth variant of the exemplary embodiment shown in FIGS. 1 and 2, which link 13C is shown in FIG. 7 and is likewise equipped with a starting device 23C controlled as a function of temperature, with regard to the blocking of the starting quantity, which blocking is controlled as a function of temperature, is of substantially simpler construction that the link 13B described previously in conjunction with FIG. 6. The working element 43C here is formed by a compression spring made of a memory alloy and arranged coaxially to the starting spring 27. So-called memory alloys have the property that the components made from them change their form within a specified, determinable temperature range. Thus the compression spring used in the link 13C as a working element 43C, when the internal combustion engine is cold, assumes a form in which its effective length LC releases the starting travel S for the slide 26C, but blocks the latter during warm starting, i.e. at normal operating temperatures. It then bears against the slide 26C with such a pretensioning force that the slide 26C cannot be moved by the regulating forces exerted by the idling springs 8. A type of construction of the working element 43C which is relatively simple to produce results when this working element 43C, in the installed position shown and at very low operating temperatures, assumes its blocked length at which the individual coils bear against one another (not shown). The slide 26C bearing the pin 31, as in the exemplary embodiment shown in FIG. 1, is guided in longitudinally displaceable manner on a guide rod 25 fixed between two webs 28 and 29, and its length, with the adjacent components, determines the starting travel S.

Figure 8:
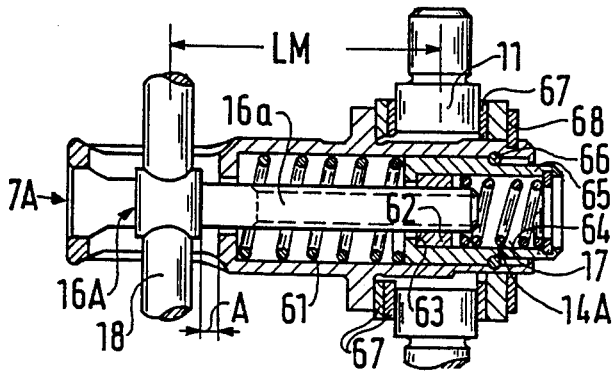

The governor sleeve 7A shown in FIG. 8 for the fifth variant of the exemplary embodiment, like the governor sleeve 7 in FIG. 1, contains the drag member 14A containing the drag spring 17 and is additionally equipped with a deflection spring 61 which, during sliding operation with the regulating lever 35 secured in the stopped position and when the control rod 3 is in the stopped position, permits a requisite increase in the distance LM existing in the no-load condition between the connecting points, formed by the connecting bolt 18 and the sliding block 11, for the centrifugal weights 5 and the coupling 9, so that, as in the case of the extendable link 13A in FIG. 5, the forces acting on the governor parts are limited by the force, then effective, of the deflection spring 61. The deflection travel A of the drag member 14A at the governor sleeve 7A, which deflection travel A is required during supercharged operation for the travel B (see FIG. 1), can be continuously adjusted by an adjusting nut 62 screwed onto the thrust bolt 16A provided with a threaded bolt **16*a* and bearing the connecting bolt 18. The adjusting nut 62 is fixed in known self-locking manner on the threaded bolt 16A, which is made possible, for example, by a plastic coating on one of the interacting threads. The adjusting nut 62 is supported on one side against the drag spring 17 and on the other side against a shoulder 63 inside a recess 64, accommodating the drag spring 17, of a sliding sleeve 65 which is longitudinally displaceable in the central bore 15 of the governor sleeve 7A. The sliding sleeve 65 is pressed in turn by the deflection spring 61 against a positional stop 66 formed by a snap ring. The mode of action of a governor sleeve of such configuration is known in principle from regulating speed governors, but designed here for the intended application while taking into account the special requirements, for example, of the deflection travel A, to be set here with relatively close tolerances, and substantially simplified with respect to the individual components so that the forces and the amounts of travel are easier to set. The sliding block 11, here only partly shown, for the articulation of the intermediate lever 12 is provided on both sides with intermediate discs 67 for accurately setting the distance LM and is held by a retaining ring 68** in the installed position shown.

The governor sleeve 7A described above in conjunction with FIG. 8 can be used in all embodiment variants, apart from that described for FIG. 5, it then facilitates the accurate setting of the deflection travel A and the distance LM and prevents overloading of the governor components.

I claim:

1. An idling/final speed governor for internal combustion engines, comprising:

quantity control means for setting a fuel injection quantity and including a control rod reciprocably movable, said control rod being formed to increase the fuel injection quantity while moving in one direction to a full load position and to decrease the fuel injection quantity while moving in an opposite direction opposite said one direction;

centrifugal-weight rectangular means (4) rotatably driveable at a speed proportional to a speed of an internal combustion engine, said centrifugal-weight regulator means (4) having centrifugal weights (5), said centrifugal weights being in an inoperative position when said centrifugal-weight regulator means (4) is not being rotatably driven, said centrifugal weights (5) being formed to exert centrifugal forces in response to said centrifugal-weight regulator means (4) being rotatably driven, said centrifugal-weight regulator means (4) also including idling springs (8) exerting biasing forces against said centrifugal weights (5), said centrifugal weights (5) cooperating with said idling springs (8) so as to move into and out of an equilibrium position in response to said centrifugal forces, said centrifugal weights being formed to move against said biasing force of said idling springs (8) in response to said centrifugal forces as caused by an increase in said speed until equilibrium develops between said centrifugal forces of said centrifugal-weights (5) and said biasing forces of said idling springs (8), said control rod (3) being formed to move in association with a movement of said centrifugal-weights (5);

means for determining a maximum fuel injection quantity and including a full-load stop (32) movable so as to adjustably block movement of said control rod (3);

means for selecting said fuel injection quantity as desired up to said maximum fuel injection quantity and including a regulating member (35);

starting means (23, 23A, 23B, 23C) for starting the internal combustion engine and including a starting spring (27) having a biasing force, said regulating member (35) being movable through a plurality of relative positions between said centrifugal weights (5) and said starting spring (27), said starting spring (27) being formed so that said control rod (3) is movable in dependence upon said relative positions of said regulating member (35) and said movement of said centrifugal weights (5) and thereby change said fuel injection quantity and so that said control rod (3) is movable into an extra-quantity position that exceeds said full-load position while said centrifugal weights are in said inoperative position so as to produce an extra starting quantity, said starting spring (27) being connected to said control rod (3) so that regulating said full-load stop (32) as a function of operating parameters does not cause any change in said biasing force of said starting spring (27);

a governor sleeve (7, 7A) having a drag member (14) with a drag spring (17), said governor sleeve (7, 7A) being formed to travel in dependence upon said speed of said centrifugal-weight regulator means (4); and a coupling (9) between said control rod (3) and said governor sleeve (7, 7A), said starting means (23, 23A, 23B, 23C) including a slide (26, 26A, 26B, 26C), said starting spring (27) being formed so as to e compressible for producing said extra starting quantity, said starting spring (27) cooperating with said full-load stop (32) so as to bias said control rod (3) in said opposite direction for decreasing said injection quantity and to load against said slide (26, 26A, 26B, 26C) for enabling said extra starting quantity, said starting mans (23, 23A, 23B, 23C) further, including guiding means for guiding said slide (26, 26A, 26B, 26C) in a regulating direction (I) of said control rod (3), said idling springs (8) being formed to exert a force on said control rod (3) and said starting means (23, 23A, 23B, 23C) via said governor sleeve (7, 7A) and said coupling (9), said slide (26, 26A, 26B, 26C) being formed to cooperate with said full-load stop (329 so that said slide (26, 26A, 26B, 26C) displaces relative to said control rod (3) along a starting travel path (S) in response to said force of said idling springs (8).

2. The idling/final speed governor as defined in claim 1; further comprising:

a governor housing (34), said full-load stop (32) being connected to said governor housing (34).

3. The idling/final speed governor as defined in claim 1; further comprising:

a link (13, 13A, 13B, 13C), said starting means (23, 23C) being arranged inside said link (13, 13A, 13B, 13C), said coupling (9) including an intermediate lever (12) leading to said governor sleeve (7, 7A), said link (13, 13A, 13B, 13C) having one side articulated to said control rod (3) and another side articulated to said intermediate lever (12).

4. The idling/final speed governor as defined in claim 3, wherein said guiding means includes a guide rod (25), said guide rod (25) having a portion surrounded by said starting spring (27) and another portion surrounded by said slide (26, 26C).

5. The idling/final speed governor as defined in claim 1, wherein said full-load stop (32) is formed so as to be movable in response to said operating parameters.

6. The idling/final speed governor as defined in claim 1, wherein said full-load stop (32) is formed so as to be movable in response to supercharge pressure.

7. The idling/final speed governor as defined in claim 5; wherein said governor sleeve is formed to accomodate said drag member (14, 14A) deflecting up to a predetermined deflection travel distance (A) in correspondance with movement by said full-load stop (32).

8. The idling/final speed governor as defined in claim 1; further comprising;

means for preventing said extra starting quantity during warm starting and including an additional stop (41) being responsive to temperature and formed so as to block said starting means (23, 23A, 23B, 23C) from displacing said control rod (3) to said extra-starting quantity position in dependence upon said temperature.

9. The idling/final speed governor as defined in claim 8, wherein said preventing means includes a lever (42) extending from said additional stop (41), said additional stop (41) being pivotally connected to said full-load stop (32).

10. The idling/final speed governor as defined in claim 9, wherein said preventing means includes means for pivotally connecting said additional stop (41) to said full-load stop (32) and including an axis (40) on said full-load stop (32).

11. The idling/final speed governor as defined in claim 9, wherein said preventing means includes a working element (43) responsive to temperature to cause said additional stop (41) to pivot on said full-load stop (32).

12. The idling/final speed governor as defined in claim 3, wherein said guiding means includes a guide bore (45) guiding said slide (26A, 26B) and accomodating said starting spring (27), said guide bore (45) being arranged in said link (13A, 13B).

13. The idling/final speed governor as defined in claim 12, wherein said link is formed as a first link body (46) and a second link body (51), said second link body (51) being coaxial to said first link body (46) and being articulated to said intermediate lever (12) at a first articulation area (49), said first link body (46) accomodating said guide bore (45) with said slide (26A) and said starting spring (27) and being articulated to said control rod (3) at a second articulation area (47); and further comprising:

means for holding apart said first articulation area (49) from said second articulation area (47) and including a drag spring (48) supported against both of said first link body (46) and said second link body (51) during normal and starting operation of the governor so as to secure said first link body (46) and said second link body (51) in their initial position and thereby holding apart said first articulation area (49) from said second articulation area (47) at a fixed distance (L), said drag spring (48) being formed to permit a requisite increase in said fixed distance (L) between said first and second articulation areas (47, 48) during sliding operation while said regulating lever (35) is in a stopped position.

14. The idling/final speed governor as defined in claim 3; further comprising:

means for inhibiting an extra-starting quantity during warm starting and including a working element (43B, 43C) having an effective length (LB, LC) changing in response to temperature to at least indirectly block said starting travel path (S) of said slide (26B, 26C), said working element (43B, 43C) being arranged inside said link (13B, 13C).

15. The idling/final speed governor as defined in claim 14, wherein said slide (26B) has a bore (52) passing therethrough, said working element (43B) being arranged in said bore (52), said working element (43B) having a housing portion (44B) and an actuating member (56), said starting means (23B) including a stop sleeve (54) in said bore (52), restoring spring means (53) for limiting said starting travel path (S) and exerting a pretensioning force F1 in one direction on said working element (43B), deflection spring means (55) exerting a pretensioning force F2 on said working element in a direction opposite to said one direction, and an abutment (57) fixed in said link (13B) and supporting said actuating member (56), said housing (44B) having one side against said stop sleeve (54).

16. The idling/final speed governor as defined in claim 15, wherein said wording element (43B) is formed as an expansion transducer.

17. The idling/final speed governor as defined in claim 15, wherein said starting spring (27) exerts a pretensioning force F3, said restoring spring means (53) being formed so that said pretensioning force F1 exerted by said restoring spring means (53) is greater than said pretensioning force F3 of said starting spring (27) and smaller than said pretensioning force F2 of deflection spring means (55).

18. The idling/final speed governor as defined in claim 14, wherein said working element (43C) is arranged coaxial to said starting spring (27), said starting spring (27) having an effective length LC so as to free said starting travel path (S) of said slide (26C) during cold starting and so as to block said starting travel path (S) of said slide (26C) during warm starting.

19. The idling/final speed governor as defined in claim 7; further comprising:

a connecting bolt (18) in said governor sleeve (7A) and moving in association with said centrifugal weights (5);

a sliding block (11) movable by said governor sleeve (7A) so as to cause said starting means (23, 23A, 23B, 23C) to move in association with said sliding block (11); and a deflection spring (61) contained within said governor sleeve (7A), said deflection spring (61) being formed to permit a requisite increase in a distance LM existing in a no-load condition between said connecting bolt (18) and said sliding block (11) during sliding operation when said regulating lever (35) is secured in a stopped position.

20. The idling/final speed governor as defined in claim 7; further comprising:

a connecting bolt (18); and adjusting means for adjusting said deflection travel path (A) of said drag member (14A) and including an adjusting nut (62), a threaded bolt (16a) on which is screwed said adjusting nut (62), a thrust bolt (16A) extending from said threaded bolt (16a) and bearing said connecting bolt (18), a positional stop (66), and a sliding sleeve (65) having a recess (64) accomodating said drag spring (17) and a shoulder (63) extending inside said recess (64), said adjusting nut (62) having one side supported against said drag spring (17) and another side supported against said shoulder (63) inside said recess (64), said adjusting means being arranged in said governor sleeve (7A), said governor sleeve (7A) having a central bore (15) in which said sliding sleeve (65) is longitudinally displaceable, said sliding sleeve (65) being pressed by said deflection spring (61) against said positional stop (66).

21. The idling/final speed governor as defined in claim 7, wherein said starting spring (27) is formed to exert a pretensioning force F3, said drag spring (17) being formed to exert a foce that is smaller than said pretensioning force F3.

22. The idling/final speed governor as defined in claim 1, wherein said starting spring (27) is formed to exert a pretensioning force F3, said idling springs (8) being formed to exert a force greater than said pretensioned force while said centrifugal weights are in said inoperative position in which said centrifugal-weight regulator means (4) is not being rotatably driven.

* * * * *